United States Patent [19]

Sugihara et al.

[11] Patent Number: 4,477,516

[45] Date of Patent: Oct. 16, 1984

[54] NON-WOVEN FABRIC OF HOT-MELT ADHESIVE COMPOSITE FIBERS

[75] Inventors: Taizo Sugihara, Moriyamashi; Yasuhiko Furukawa, Kusatsushi; Susumu Tomioka, Shigaken, all of Japan

[73] Assignee: Chisso Corporation, Osaka, Japan

[21] Appl. No.: 508,223

[22] Filed: Jun. 27, 1983

[30] Foreign Application Priority Data

Jun. 29, 1982 [JP] Japan ..... 57-111967

[51] Int. Cl.[3] ..... D02G 3/00; D04H 1/04

[52] U.S. Cl. ..... 428/296; 428/373; 428/374

[58] Field of Search ..... 428/296, 288, 373, 374, 428/375, 394; 156/167, 181, 306; 525/240; 264/171

[56] References Cited

U.S. PATENT DOCUMENTS

| | | | |
|---|---|---|---|
| 3,231,650 | 1/1966 | Findlay et al. | 428/296 X |
| 3,511,747 | 5/1970 | Davies | 428/296 X |
| 3,589,956 | 6/1971 | Krantz et al. | 156/306 |
| 3,595,731 | 7/1971 | Davies et al. | 156/306 |
| 3,760,046 | 9/1973 | Schwartz et al. | 428/373 X |
| 4,189,338 | 2/1980 | Ejima . | |
| 4,211,816 | 7/1980 | Booker et al. | 428/296 |
| 4,323,626 | 4/1982 | Kunimune et al. | 428/296 |

FOREIGN PATENT DOCUMENTS

| | | | |
|---|---|---|---|
| 752824 | 2/1967 | Canada | 428/296 |
| 070163 | 1/1983 | European Pat. Off. | 428/296 |
| 74637 | 7/1970 | Fed. Rep. of Germany | 428/373 |
| 1073181 | 6/1967 | United Kingdom | 428/296 |
| 2096048 | 10/1982 | United Kingdom | 428/374 |

*Primary Examiner*—Lorraine T. Kendell

*Attorney, Agent, or Firm*—Fred Philpitt

[57] ABSTRACT

A non-woven fabric of hot-melt-adhesive composite fibers having a specified small weight per unit area and soft feeling is provided which fibers are obtained by forming a fiber aggregate consisting of hot-melt-adhesive composite fibers of a specified fineness, alone, composed of as a first component, a polyethylene resin composition (C) consisting of (A) a straight chain, low density polyethylene and (B) another kind of polyethylene, in a specified proportion, and having a specified density and a specified ratio of its melt indexes after and before spinning, and as a second component, a fiber-formable polymer having a m.p. higher than those of either of the polyethylenes constituting the first component, the first component constituting at least a part of the fiber surface of the composite fibers continuously in the longitudinal direction thereof, or a fiber aggregate of a specified average fineness which is mixed fibers of the composite fibers with other fibers of a specified fineness; and subjecting either one of the fiber aggregates to heat treatment at a specified temperature.

10 Claims, No Drawings

NON-WOVEN FABRIC OF HOT-MELT ADHESIVE COMPOSITE FIBERS

BACKGROUND OF THE INVENTION

1. Field of the Invention

This invention relates to a non-woven fabric. More particularly it relates to a non-woven fabric of hot-melt-adhesive composite fibers having a small weight per unit area thereof.

2. Description of the Prior Art

Non-woven fabrics obtained by using composite fibers composed of composite components of fiberformable polymers having different melting points from one another (hereinafter often referred to as hot-melt-adhesive composite fibers) have been known (see Japanese patent publication Nos. Sho 42-21318/1967, Sho 44-22547/1969, Sho 52-12830/1977, etc.). In recent years, the performance level of non-woven fabrics required therefor has also been more and more elevated, with the variety of the application fields of non-woven fabrics, and it has been basically required for non-woven fabrics to have a weight of non-woven fabric as small as possible and yet retain a strength of non-woven fabric as high as possible, and also exhibit a feeling as soft as possible. However, according to the above-mentioned known processes wherein composite fibers composed of composite components having different melting points from one another are merely used, it has been impossible to satisfy the above-mentioned requirements.

In order to obtain a non-woven fabric having a weight of non-woven fabric as small as possible and yet retaining a strength of non-woven fabric as high as possible, and also exhibiting a feeling as soft as possible, necessary conditions therefor are as follows:

(1) the non-woven fabric is composed of hot-melt-adhesive composite fibers of fine denier; and (2) the lower melting component of hot-melt-adhesive composite fibers contributing to hot-melt-adhesion is soft and has a small and soft area of hot-melt-adhesion points. The soft feeling referred to herein means a soft and elastic feeling as represented by gauze.

The lower melting component of hot-melt-adhesive composite fibers so far used for constituting non-woven fabrics of hot-melt-adhesive composite fibers is polyethylene, and polyethylene used in the form of fibers is usually medium density or high density polyethylene, but these polyethylenes have a drawback that they have a high rigidity so that non-woven fabrics obtained therefrom are liable to exhibit a hard feeling. On the other hand, low density polyethylene has a low rigidity so that a soft feeling can be expected from non-woven fabrics obtained from the polyethylene, but it has an inferior spinnability and stretchability so that only thick fibers can be obtained; hence it is the present status that the expected soft feeling could not have been realized.

The object of the present invention is to provide a non-woven fabric of hot-melt-adhesive composite fibers without the above-mentioned drawbacks of conventional polyethylene, having a small weight per unit area thereof and hence a soft feeling.

SUMMARY OF THE INVENTION

The present invention resides in:

a non-woven fabric of hot-melt-adhesive composite fibers having a small weight per unit of area of 8 to 30 g/m$^2$, obtained by forming a fiber aggregate consisting of hot-melt-adhesive composite fibers of 4 deniers or less, alone, composed of as a first component, a polyethylene resin composition (C) consisting of (A) 50 to 100% by weight of a linear, low density polyethylene (hereinafter often referred to as L-LDPE) and (B) 50 to 0% by weight of another kind of polyethylene, and having a density of 0.91 to 0.94 g/cm$^3$ and a ratio of its melt index after spinning to that before spinning of 0.75 or higher, and as a second component, a fiber-formable polymer having a melting point higher than those of either of the polyethylenes constituting the first component by 30° C. or higher, the first component constituting at least a part of the fiber surface of the composite fibers continuously in the longitudinal direction thereof, or a fiber aggregate of 4 deniers or less in average which is mixed fibers of the composite fibers with other fibers of 6 deniers or less containing at least 25% by weight of the composite fibers based on the total weight of the mixed fibers; and subjecting either one of the fiber aggregates to heat treatment at a temperature equal to or higher than the melting point of the first component of the composite fibers but lower than the melting point of the second component thereof to stabilize the shape of the resulting non-woven fabric.

DETAILED DESCRIPTION OF THE PREFERRED EMBODIMENTS

Polyethylene (A) used in the present invention may be obtained by subjecting ethylene together with an $\alpha$-olefin of 4 to 8 carbon atoms as a comonomer to anionic coordination polymerization in the presence of a catalyst, and may be chosen from among products which, in recent years, have been commercially available by the name of linear, low density polyethylene. Further, those having a durometer hardness of 65 or less according to JIS K7215 may be preferably used.

Polyethylene (B) used in the present invention may be any one of conventional, commercially available low density polyethylene, medium density polyethylene and high density polyethylene, and also may be a mixture of these polyethylenes.

The reason that the concentration of polyethylene (A) and that of polyethylene (B) in the polyethylene resin composition (C) are limited to 50 to 100% by weight and 50 to 0% by weight, respectively is as follows:

In the case where low density polyethylene having a low hardness is used as polyethylene (B) for the reason that this has little fear of damaging the feel of non-woven fabric, and the concentration of polyethylene (A) is less than 50% by weight, the spinnability of the composite fibers lowers and there occurs peeling-off of the composite components from one another at the time of stretching to make it impossible to obtain hot-melt-adhesive composite fibers having a small denier, and as a result, only a non-woven fabric having a hard feeling and an insufficient strength can be obtained; on the other hand, in the case where medium density polyethylene or high density polyethylene having a superior spinnability and stretchability and also a high hardness is used, and the concentration of polyethylene (A) is less than 50% by weight, hot-melt-adhesive composite fibers having a small denier can be obtained, but it is impossible to improve the feel of non-woven fabric which has so far been a drawback.

The density of the polyethylene resin composition (C) is determined by the mixing ratio of polyethylene (A) to polyethylene (B), and the reason that this density is limited to 0.910 to 0.940 is that if the density of the composition (C), which is the average by weight of the respective densities of polyethylene (A) and polyethylene (B) corresponding to the mixing ratio of these polyethylenes, exceeds 0.94, then the feeling of the resulting non-woven fabric is hard even if the concentration of polyethylene (A) in the composition (C) is 50% by weight or higher. The cause that there is observed a correlationship between the density of the polyethylene composition (C) which is an adhesive component of the hot-melt-adhesive composite fibers and the feeling of a non-woven fabric composed of the fibers is understood to be in that there is a correlationship between the density and hardness of polyethylene and also there is observed a correlationship between the hardness of polyethylene and the feeling of the resulting non-woven fabric. The reason that the lower limit of the density of the polyethylene resin composition (C) is limited to 0.910 g/cm$^3$ is that this lower limit is that of the density of usually commercially available polyethylene.

The reason that the ratio of the melt index of the polyethylene resin composition (C) after spinning to that before spinning is limited to 0.75 or higher in the present invention, is that if the resin composition has a ratio of the melt indexes less than 0.75, its spinnability is generally inferior to make it difficult to obtain hot-melt-adhesive composite fibers having a small denier, and even if the spinnability is retained, it is difficult to achieve the soft feel of non-woven fabric desired in the present invention. The reason that the melt index ratio has an influence upon the spinnability and the feel of non-woven fabric, is understood to be in that polyethylene, when subjected to heat treatment, generally forms an intermolecular cross-linking, and as the degree of cross-linking increases, the melt index decreases, and at the same time the spinnability becomes inferior and the stiffness increases. In order to obtain the polyethylene resin composition (C) having a melt index ratio of 0.75 or higher, the polyethylene composition consisting of polyethylene (A) and polyethylene (B) is singly spun under the same conditions as the spinning conditions of the first component at the time of the composite spinning, and before this spinning, the melt indexes before and after the spinning are measured, and polyethylene (A), polyethylene (B) and the blending ratio of these polyethylenes are chosen and established according to trial and error method, so that the melt index ratio can be 0.75 or higher.

The reason that the melting point of the second component of the hot-melt-adhesive composite fibers is limited to a temperature which is higher than the melting points of either of the polyethylenes constituting the first component, by 30° C. or higher, is that in order to obtain a non-woven fabric having a superior strength, it is necessary to carry out the heat treatment process for converting the composite fibers into non-woven fabric at a temperature which is higher than the melting points of either of the polyethylenes constituting the first component, as described later, and if the second component softens or melts at this heat treatment temperature, the hot-melt-adhesive composite fibers cause heat shrinkage which unfavorably hinders the dimensional stability of the resulting non-woven fabric or increase the area of hot-melt-adhesion points to make the feeling of non-woven fabric inferior; hence if the temperature difference is 30° C. or higher as described above, the heat treatment temperature which makes the strength of non-woven fabric compatible with the feeling thereof can be easily choiced.

As the fiber-formable polymer constituting the second component, any of polymers capable of melt-spinning such as polypropylene, polyesters, polyamides, etc. may be used.

The composite shape of the first component with the second component may be either one of side-by-side type or sheath and core type, but since the hot-melt-adhesive composite fibers used in the present invention are obtained by utilizing the hot-melt-adhesive effect of the first component, the first component must be arranged so as to constitute at least a part of the composite fiber surface continuously in the longitudinal direction of the fibers.

The hot-melt-adhesive composite fibers used in the present invention can be produced by the use of so far known composite spinning apparatus. The melt-spinning temperature on the first component side is in the range of 180° to 300° C., preferably 180 to 250° C., and that on the second component side may be established according to the conditions in the case where the fiber-formable polymer selected as the second component is singly spun. As for resulting spun unstretched composite fibers, it is possible to omit the stretching process as far as the fibers are of 4 deniers or less, but the unstretched fibers are generally preheated to a temperature of room temperature to 100° C. and stretched to 2 to 6 times the original length to obtain hot-melt-adhesive composite fibers.

As the fiber aggregate to be converted by heat treatment into non-woven fabric in the present invention, there is used not only a fiber aggregate consisting only of hot-melt-adhesive composite fibers of 4 deniers or less having the above-mentioned specific features, but also there can be preferably used a fiber aggregate of 4 deniers or less in average consisting of a mixture of the composite fibers with other fibers of 6 deniers or less containing at least 25% by weight of the composite fibers in the mixture. As the other fibers, any of those which do not cause melting or notable heat shrinkage at the time of heat treatment for producing the non-woven fabric and also satisfy the abovementioned denier condition may be used. One kind or more of fibers such as natural fibers e.g. cotton, wool, etc., semi-synthetic fibers e.g. viscose rayon, cellulose acetate fibers, etc., and synthetic fibers e.g. polyolefin fibers, polyamide fibers, polyester fibers, acrylic fibers, etc., may be suitably choiced and used, and their amount used is 75% by weight or less based on the total amount of the fibers and the composite fibers. If the proportion of the hot-melt-adhesive composite fibers in the fiber aggregate is less than 25% by weight, the strength of the resulting non-woven fabric is reduced.

The reason that when the fiber aggregate is formed, the fineness of the hot-melt-adhesive composite fibers is limited to 4 deniers or less; the fineness of the other fibers to be mixed with the hot-melt-adhesive composite fibers is limited to 6 deniers or less; and the average fineness of the mixed fibers is limited to 4 deniers or less, is that if fibers thicker than these finenesses are used, it is impossible to obtain a non-woven fabric having a superior feeling even if hot-melt-adhesive composite fibers satisfying the above-mentioned various limitative conditions are used.

As for the process for forming a fiber aggregate from the composite fibers, alone or mixed fibers thereof with other fibers, any of the known processes for producing general non-woven fabrics may be used such as carding process, air-laying process, dry pulping process, wet paper-making process, etc.

For the heat treatment process for converting the fiber aggregate into non-woven fabric by the hot-melt-adhesion of the lower melting component of the composite fibers, any of means may be employed such as dryers e.g. hot air dryer, suction drum dryer, Yankee dryer, etc., heating rolls e.g. flat calendering rolls, emboss rolls, etc.

The reason that the weight per unit area of the non-woven fabric aimed in the present invention is limited to 8 to 30 g/m$^2$ is that the object of the present invention is to keep a strength of non-woven fabric as high as possible and a soft feeling in a weight of non-woven fabric as small as possible, and the strengths of non-woven fabric in either of the longitudinal or lateral directions are required to be 400 g or more, preferably 600 g or more, in the field of covering materials where higher strengths are most required, such as goods for menstruation, diaper, etc.; if the weight of non-woven fabric is less than 8 g/m$^5$, it is difficult to keep a strength of 400 g/$^5$, cm even if the fiber aggregate used in the present invention is singly used; while if the weight of non-woven fabric exceeds 30 g/m$^2$, such a large weight of non-woven fabric is contrary to the object of the present invention since it is possible to obtain a non-woven fabric having a strength of non-woven fabric of 400 g or higher and also a soft feeling, even from conventional fibers.

The present invention will be further described by way of Examples. In addition, the methods for measuring the values of physical properties shown in Examples and their definitions are summarily shown below.

Strength of non-woven fabric:

This was measured according to testing method for tensile strength and elongation of JIS L1085 (testing method for padding cloth of non-woven fabric), i.e. by gripping a sample of 5 cm wide and 20 cm long and pulling it through an interval of 10 cm at a rate of pulling of 30 ±2 cm/min.

Feeling of non-woven fabric:

(1) Method for organoleptic test:

Organoleptic tests were carried out by 5 panelers. When a sample was judged to be soft, by all persons, it was designated as o in the evaluation; when judged to be soft, by 3 persons or more, it was designated as Δ; and when judged to be deficient in soft feeling, it was designated as x.

(2) Heart loop method:

Test pieces of 2.5 cm wide and 20 cm long were taken from a non-woven fabric in the longitudinal direction and lateral direction, respectively, and rounded into a heart shape according to JIS L1018 (a testing method for knit fabrics). The feeling was designated in terms of the average value of the respective lengths (mm) of loops obtained at that time.

Melt index ratio:

This was sought by dividing the melt index ($MI_f$) of polyethylene (unstretched filaments) after spinning, by the melt index ($MI_o$) of polyethylene (raw material resin) before spinning. Measurement of the melt indexes was carried out according to conditions (E) of ASTM D1238.

Evaluation of spinnability:

Spinning was continuously carried out for one hour, and in the evaluation the case where fiber breakage did not occur per one spindle was designated as o; the case where it occurred once or less was designated as Δ; and the case where it occurred twice or more was designated as x.

Evaluation of stretchability:

In the evaluation, the case where single filament breakage did not occur even in a stretch ratio of 4.0 times or more was designated as o; the case where single filament breakage occurred in a stretch ratio of 4.0 times or more, but it did not occur in the range of less than 4.0 times to 3.0 times or more was designated as Δ; and the case where it occurred in a ratio of 3.0 times or more was designated as x. Example 1

Unstretched filaments were obtained by melt-spinning under the following conditions:

First component (sheath component): a L-LDPE having a density of 0.920, a nominal melt index of 25, a durometer hardness according to JIS K7215, of 57, and a melting point of 123° C.

Second component (core component); a polypropylene having a melt flow rate of 15 and a melting point of 165° C.

Spinning die: hole diameter, 0.5 mm; number of holes, 300.

Extrusion temperature of first component: 200° C.

Extrusion temperature of second component: 300° C.

Temperature of spinning die: 240° C.

Composite ratio of first component to second component: 50 : 50.

Further, the first component alone was spun by stopping the gear pump on the second component side to take a sample for measuring the melt index of the first component after spinning of this component. Unstretched filaments obtained by the composite spinning were preheated to 100° C. and stretched to 4.0 times to obtain stretched filaments of 3.5 deniers, which were then crimped in a stuffer box and cut to a fiber length of 51 mm. The resulting composite short fibers were fed to a carding machine to obtain a web having a weight per unit area of 15 g/m$^2$, which were then subjected to heat treatment by a calendering roll composed of a metal heating roll and a rubber roll at a temperature of 128° C. and a linear pressure of 45 Kg/cm to obtain a non-woven fabric. Characteristics of the hot-melt-adhesive composite fibers are shown in Table 1 and characteristics of the resulting non-woven fabric are shown in Table 2.

EXAMPLE 2

Spinning and stretching were carried out as in Example 1 except that a blend consisting of 55% by weight of the L-LDPE used in Example 1 and 45% by weight of a medium density polyethylene having a density of 0.944, a nominal melt index of 25, a durometer hardness of 66 and a melting point of 120° C. was used as a first component and a polypropylene having a melt flow rate of 8 was used as a second component, and also both the components were arranged side by side, to obtain composite short fibers having 2.0 deniers.

Further a non-woven fabric was obtained under the same conditions as in Example 1 except that a weight per unit area of 10 g/m$^2$ was aimed. Characteristics of the hot-melt-adhesive composite fibers are shown in Table 1 and the strength and feeling evaluations of the resulting non-woven fabric are shown in Table 2.

COMPARATIVE EXAMPLE 1

Composite fibers and a non-woven fabric were obtained as in Example 2 except that the composition of the first component was made 45% by weight of L-LDPE and 55% by weight of a medium density polyethylene. Characteristics of the fibers and non-woven fabric are shown in Table 1 and Table 2.

EXAMPLE 3

When sheath and core type composite fibers were produced as in Example 1 except that a blend consisting of 55% by weight of an L-LDPE used in Example 1 and 45% by weight of a low density polyethylene having a density of 0.916, a nominal melt index of 23, a durometer hardness of 48 and a melting point of 110° C. was used as the first component, then single filament breakage occurred at the time of spinning, and when the stretch ratio was made 3.5 times or more, peel occurred between the composite components; thus 4.0 deniers were the minimum fineness attainable. Using the fibers of 4.0 deniers, a non-woven fabric was obtained as in Example 2. Properties of the fibers and non-woven fabric are shown in Tables 1 and 2.

COMPARATIVE EXAMPLE 2

When composite spinning was carried out under the same conditions as in Example 3 except that the composition of the first component was 45% by weight of the L-LDPE and 55% by weight of the low density polyethylene, then single filament breakage frequently occurred at the time of spinning, and when the stretch ration was 3.0 times or more, peel occurred between the composite components, and the minimum fineness attainable was 7.3 deniers. Using the fibers, a non-woven fabric was obtained as in Example 3. Properties of the fibers and non-woven fabric are shown in Tables 1 and 2.

EXAMPLE 4

Composite fibers were produced under the same conditions as in Example 1 except that the composition of the first component was 85% by weight of an L-LDPE having a density of 0.935, a nominal melt index of 40, a durometer hardness of 64 and a melting point of 124° C. and 15% by weight of a high density polyethylene having a density of 0.960, a nominal melt index of 25, a durometer hardness of 70 and a melting point of 132° C., and a non-woven fabric was then obtained under the conditions as in Example 2 except that the calendering roll temperature was made 135° C. Properties of the fibers and non-woven fabric are shown in Tables 1 and 2.

COMPARATIVE EXAMPLE 3

Composite fibers and a non-woven fabric therefrom were obtained under the same conditions as in Example 4 except that the composition of the first component was 75% by weight of the L-LDPE and 25% by weight of the high density polyethylene. Properties of the fibers and non-woven fabric are shown in the Tables.

EXAMPLE 5

When spinning and stretching were carried under the same conditions as in Example 1, using as a first component (sheath component), a blend of 60% by weight of the L-LDPE used in Example 1 and 40% by weight of a medium density polyethylene having a density of 0.944, a nominal melt index of 35, a durometer hardness of 65 and a melting point of 120° C. and as a second component (core component), the polypropylene used in Example 2, then sheath and core type composite fibers of 3 deniers could be easily obtained. Using the composite fibers, a non-woven fabric was obtained under the same conditions as in Example 2. Properties of the composite fibers and non-woven fabric are shown in Tables 1 and 2.

COMPARATIVE EXAMPLE 4

Composite fibers and a non-woven fabric therefrom were obtained as in Example 5 except that the composition of the first component was 50% by weight of the L-LDPE and 50% by weight of the medium density polyethylene, but filament breakage occurred during the spinning and stretching processes and the minimum fineness attained was 5.3 deniers. Properties of the composite fibers and non-woven fabric are shown in Tables 1 and 2.

EXAMPLE 6

Composite fibers and a non-woven fabric therefrom were obtained as in Example 5 except that the second component was a polyethylene terephthalate having an intrinsic viscosity of 0.65 and a melting point of 258° C. and the spinning die temperature was 300° C. Spinnability was good and composite fibers of 3 deniers were easily obtained. Properties of the composite fibers and non-woven fabric are shown in Tables 1 and 2.

COMPARATIVE EXAMPLE 5

Composite fibers were produced as in Example 6 except that the composition of the first component was 50% by weight of the L-LDPE and 50% by weight of the medium density polyethylene. Filament breakage occurred during the spinning and stretching processes, and the minimum fineness attained was 6.4 deniers.

EXAMPLES 7 AND COMPARATIVE EXAMPLE 6

Using composite short fibers obtained in Example 1 and according to the process for producing non-woven fabric as in Example 1, there were obtained a non-woven fabric (Example 7) wherein a weight per unit area 8 g/m$^2$ was aimed and a non-woven fabric (Comparative example 6) wherein a weight per unit area of 7 g/m$^2$ was aimed. Properties of these non-woven fabrics are shown in Table 2.

EXAMPLES 8~10 AND COMPARATIVE EXAMPLES 7~9

Non-woven fabrics were obtained by using mixed fibers prepared by blending other fibers to the composite short fibers obtained in Example 1; converting the fibers into a web; and subjecting it to a calendering roll process, as in Example 1. Properties of the mixed fibers and non-woven fabrics are shown in Table 2.

TABLE 1

| No. of Example and Compara- | First component | | | | |
|---|---|---|---|---|---|
| | L-LDPE (A) | | Other polyethylenes (B) | | Composition (C) |
| | | Mixing propor- | | Mixing propor- | MI after spinning / MI before |

TABLE 1-continued

| tive example | Density (g/cm³) | M.P. (°C.) | tion (%) | Type — | Density (g/cm³) | M.P. (°C.) | tion (%) | Density (g/cm³) | spinning (g/10 mm) | Ratio — |
|---|---|---|---|---|---|---|---|---|---|---|
| Ex. 1 | 0.920 | 123 | 100 | — | — | — | — | 0.920 | 20.5/25.0 | 0.82 |
| Ex. 2 | 0.920 | 123 | 55 | MDPE | 0.944 | 120 | 45 | 0.931 | 20.0/23.6 | 0.85 |
| Comp. ex. 1 | 0.920 | 123 | 45 | MDPE | 0.944 | 120 | 55 | 0.933 | 19.6/23.3 | 0.84 |
| Ex. 3 | 0.920 | 123 | 55 | LDPE | 0.916 | 110 | 45 | 0.918 | 18.5/24.0 | 0.77 |
| Comp. ex. 2 | 0.920 | 123 | 45 | LDPE | 0.916 | 110 | 55 | 0.918 | 18.3/23.8 | 0.77 |
| Ex. 4 | 0.935 | 124 | 85 | HDPE | 0.960 | 132 | 15 | 0.939 | 29.8/34.3 | 0.87 |
| Comp. ex. 3 | 0.935 | 124 | 75 | HDPE | 0.960 | 132 | 25 | 0.941 | 30.5/35.9 | 0.85 |
| Ex. 5 | 0.920 | 123 | 60 | MDPE | 0.944 | 120 | 40 | 0.930 | 22.9/29.7 | 0.77 |
| Comp. ex. 4 | 0.920 | 123 | 50 | MDPE | 0.944 | 120 | 50 | 0.932 | 22.7/31.5 | 0.72 |
| Ex. 6 | 0.920 | 123 | 60 | MDPE | 0.944 | 120 | 40 | 0.930 | 23.1/30.4 | 0.76 |
| Comp. ex. 5 | 0.920 | 123 | 50 | MDPE | 0.944 | 120 | 50 | 0.932 | 23.1/31.7 | 0.73 |

| No. of Ex. and Compar. ex. | Second component | | Hot-melt-adhesive fibers | | | | |
|---|---|---|---|---|---|---|---|
| | Name | M.P. (°C.) | Composite shape | Composite ratio of 1st/2nd | Spinnability evaluation | Stretch-ability evaluation | Fineness (d) |
| Ex. 1 | PP*1 | 165 | Sheath and core | 50/50 | o | o | 3.5 |
| Ex. 2 | PP*2 | 165 | Side by side | 50/50 | o | o | 2.0 |
| Comp. ex. 1 | PP*2 | 165 | Side by side | 50/50 | o | o | 2.0 |
| Ex. 3 | PP*1 | 165 | Sheath and core | 50/50 | Δ | Δ | 4.0 |
| Comp. ex. 2 | PP*1 | 165 | Sheath and core | 50/50 | x | x | 7.3 |
| Ex. 4 | PP*1 | 165 | Sheath and core | 50/50 | o | o | 2.0 |
| Comp. ex. 3 | PP*1 | 165 | Sheath and core | 50/50 | o | o | 2.0 |
| Ex. 5 | PP*1 | 165 | Sheath and core | 50/50 | o | o | 3.0 |
| Comp. ex. 4 | PP*1 | 165 | Sheath and core | 50/50 | x | o | 5.3 |
| Ex. 6 | PET*3 | 258 | Sheath and core | 50/50 | o | o | 3.0 |
| Comp. ex. 5 | PET | 258 | Sheath and core | 50/50 | x | x | 6.4 |

*1Polypropylene, MFR = 15
*2Polypropylene, MFR = 8
*3Polyester, intrinsic viscosity = 0.65

TABLE 2

| | Constitution of non-woven fabric | | | | | | Properties of non-woven fabric | | | | |
|---|---|---|---|---|---|---|---|---|---|---|---|
| | Hot-melt-adhesive composite fibers | | Other fibers | | | | Mixed fibers | Weight | | Feeling | |
| | Fineness (d) | Mixing proportion (%) | Kind | Fineness (d) | Fiber length (mm) | Mixing proportion (%) | Average fineness (d) | per unit area (g/m²) | Strength (g/5 cm) | Organoleptic test | Heart loop method (mm) |
| Ex. 1 | 3.5 | 100 | — | | — | — | 3.5 | 15.0 | 820 | o | 56 |
| Ex. 2 | 2.0 | 100 | — | | — | — | 2.0 | 10.3 | 619 | o | 50 |
| Comp. ex. 1 | 2.0 | 100 | — | | — | — | 2.0 | 10.0 | 645 | x | 42 |
| Ex. 3 | 4.0 | 100 | — | | — | — | 4.0 | 11.1 | 533 | o | 64 |
| Comp. ex. 2 | 7.3 | 100 | — | | — | — | 7.3 | 12.0 | 420 | x | 40 |
| Ex. 4 | 2.0 | 100 | — | | — | — | 2.0 | 10.7 | 603 | o | 53 |
| Comp. ex. 3 | 2.0 | 100 | — | | — | — | 2.0 | 10.5 | 622 | x | 44 |
| Ex. 5 | 3.0 | 100 | — | | — | — | 3.0 | 13.3 | 732 | o | 51 |
| Comp. ex. 4 | 5.3 | 100 | — | | — | — | 5.3 | 13.0 | 573 | x | 43 |
| Ex. 6 | 3.0 | 100 | — | | — | — | 3.0 | 12.5 | 675 | o | 52 |
| Comp. ex. 5 | 6.4 | 100 | — | | — | — | — | — | — | — | — |
| Ex. 7 | 3.5 | 100 | — | | — | — | 3.5 | 8.2 | 403 | o | 60 |
| Comp. ex. 6 | 3.5 | 100 | — | | — | — | 3.5 | 7.3 | 365 | o | 62 |
| Ex. 8 | 3.5 | 25 | PP | 2.0 | 51 | 75 | 2.4 | 29.7 | 415 | o | 64 |
| Comp. ex. 7 | 3.5 | 22 | PP | 2.0 | 51 | 78 | 2.3 | 30.3 | 357 | o | 63 |

TABLE 2-continued

| | Constitution of non-woven fabric | | | | | | Properties of non-woven fabric | | | | |
|---|---|---|---|---|---|---|---|---|---|---|---|
| | Hot-melt-adhesive composite fibers | | Other fibers | | | | Mixed fibers | Weight | | Feeling | |
| | Fineness (d) | Mixing proportion (%) | Kind | Fineness (d) | Fiber length (mm) | Mixing proportion (%) | Average fineness (d) | per unit area (g/m²) | Strength (g/5 cm) | Organoleptic test | Heart loop method (mm) |
| Ex. 9 | 3.5 | 65 | PET | 5.0 | 64 | 35 | 4.0 | 24.5 | 722 | Δ | 53 |
| Comp. ex. 8 | 3.5 | 35 | PET | 5.0 | 64 | 65 | 4.5 | 25.0 | 430 | x | 48 |
| Ex. 10 | 3.5 | 80 | PET | 5.5 | 64 | 20 | 3.9 | 20.7 | 828 | o | 52 |
| Comp. ex. 9 | 3.5 | 90 | PET | 6.5 | 64 | 10 | 3.8 | 20.0 | 904 | x | 44 |

What is claimed is:

1. A non-woven fabric of hot-melt-adhesive composite fibers having a weight per unit area of 8 to 30 g/m² obtained by (1) forming a fiber aggregate consisting of hot-melt-adhesive composite fibers of 4 deniers or less, composed of (a) as a first component a polyethylene resin composition (C) consisting of (A) 50 to 100% by weight of a straight chain low density polyethylene (L-LDPE) and (B) 50 to 0% by weight of another kind of polyethylene, said first component having a density of 0.910 to 0.940 g/cm³ and a ratio of its melt index after spinning:before spinning of 0.75 or higher, and (b) as a second component a fiber-formable polymer having a melt point higher than those of either polyethylenes (A) or (B) by 30° C. or more, the first component constituting at least a part of the fiber surface of the composite fibers continuously in the longitudinal direction thereof, (2) subjecting the fiber aggregate to heat treatment at a temperature equal to or higher than the melt point of the first component of the composite fibers but lower than the melting point of the second component thereof to stabilize the shape by hot melt adhesion.

2. A non-woven fabric of hot-melt-adhesive composite fibers having a weight per unit area of 8 to 30 g/m² obtained by (1) forming an aggregate of fibers having an average of 4 deniers or less composed of a mixture of (i) the hot-melt composite fibers set forth in claim 1, and (ii) other fibers of 6 deniers or less said mixture containing at least 25% by weight of the composite fibers (i) based on the total weight of (i) and (ii), and (2) subjecting the fiber aggregate to heat treatment at a temperature equal to or higher than the melting point of the first component of the composite fibers but lower than the melting point of the second component thereof to stabilize the shape of the resulting non-woven fabric.

3. A non-woven fabric according to claim 1 wherein said second component is polypropylene.

4. A non-woven fabric according to claim 2 wherein said second component is polypropylene.

5. A non-woven fabric according to claim 1 wherein said first component is a mixture of L-LDPE and MDPE.

6. A non-woven fabric according to claim 2 wherein said first component is a mixture of L-LDPE and MDPE.

7. A non-woven fabric according to claim 1 wherein said first component consists of 55% L-LDPE and 45% MDPE.

8. A non-woven fabric according to claim 2 wherein said first component consists of 55% L-LDPE and 45% MDPE.

9. A non-woven fabric according to claim 1 wherein said first component consists of 85% L-LDPE and 15% HDPE.

10. A non-woven fabric according to claim 2 wherein said fist component consists of 85% L-LDPE and 15% HDPE.

* * * * *